US011504767B2

(12) United States Patent
Jiang et al.

(10) Patent No.: US 11,504,767 B2
(45) Date of Patent: Nov. 22, 2022

(54) METHOD FOR PREPARING SOFT MAGNETIC MATERIAL BY USING LIQUID NITROGEN THROUGH HIGH-SPEED BALL MILLING

(71) Applicant: Jiangnan University, Wuxi (CN)

(72) Inventors: Yanfeng Jiang, Wuxi (CN); Ru Li, Wuxi (CN); Linxin Jiang, Berkeley, CA (US)

(73) Assignee: JIANGNAN UNIVERSITY, Wuxi (CN)

( * ) Notice: Subject to any disclaimer, the term of this patent is extended or adjusted under 35 U.S.C. 154(b) by 187 days.

(21) Appl. No.: 16/881,114

(22) Filed: May 22, 2020

(65) Prior Publication Data

US 2020/0282458 A1 Sep. 10, 2020

Related U.S. Application Data

(63) Continuation of application No. PCT/CN2018/120823, filed on Dec. 13, 2018.

(30) Foreign Application Priority Data

Dec. 11, 2018 (CN) ..... 201811510450.X

(51) Int. Cl.
*B22F 1/00* (2022.01)
*H01F 1/147* (2006.01)
(Continued)

(52) U.S. Cl.
CPC ..... *B22F 1/142* (2022.01); *B22F 9/04* (2013.01); *H01F 1/147* (2013.01); *H01F 41/02* (2013.01);
(Continued)

(58) Field of Classification Search
None
See application file for complete search history.

(56) References Cited

U.S. PATENT DOCUMENTS

2014/0376837 A1* 12/2014 Sun ..... H01F 1/447 384/8
2018/0001385 A1* 1/2018 Wang ..... H01F 41/0266

FOREIGN PATENT DOCUMENTS

CN 107396631 A 11/2017
JP S6476906 A 3/1989
WO WO-2016122987 A1 * 8/2016 ..... B22F 1/0007

OTHER PUBLICATIONS

PCT/CN2018/120823 ISA210 ISR dated Aug. 28, 2019.

* cited by examiner

*Primary Examiner* — Xiaowei Su
(74) *Attorney, Agent, or Firm* — IPro, PLLC; Na Xu

(57) ABSTRACT

The disclosure discloses a method for preparing a γ'-$Fe_4N$ soft magnetic material by using liquid nitrogen through high-speed ball milling, and belongs to the field of the soft magnetic material. According to the method of the disclosure, high energy in the liquid nitrogen is used for obtaining a nanometer material $Fe_xN$ with a nitrogen atom supersaturation degree through cryogrinding. At a low temperature, the material is very brittle, and a surface volume ratio is very high, so that a content of nitrogen atoms adsorbed on a surface of a sample is as high as 22%. Through 300° C. post-annealing, γ'-$Fe_4N$ is directly obtained from α-Fe through phase change, so that a nanometer crystal γ'-$Fe_4N$ soft magnetic material is prepared. The method of the disclosure has the advantages that an operation is simple and convenient, the cost is low, the large-scale industrialized production can be realized, and the method belongs to a novel alternative method for preparing a high-grade soft
(Continued)

magnetic material with ideal magnetism. The γ'-$Fe_4N$ soft magnetic material prepared by the method of the disclosure has the advantages of high Ms, low coercivity and high surface resistivity, and can be used for a transformer and an inductor operated in a high-frequency semiconductor switch.

10 Claims, 2 Drawing Sheets

(51) Int. Cl.
*H01F 41/02* (2006.01)
*B22F 9/04* (2006.01)
*B22F 1/142* (2022.01)

(52) U.S. Cl.
CPC ..... *B22F 2009/043* (2013.01); *B22F 2302/20* (2013.01)

METHOD FOR PREPARING SOFT MAGNETIC MATERIAL BY USING LIQUID NITROGEN THROUGH HIGH-SPEED BALL MILLING

TECHNICAL FIELD

The disclosure belongs to the field of a soft magnetic material, and particularly relates to a method for preparing a γ'-$Fe_4N$ soft magnetic material by using liquid nitrogen through high-speed ball milling.

BACKGROUND

From the early 1950s, people have studied iron nitride materials, and they originally intended to study a nitridation phenomenon on an iron and steel surface for improving hardness and anti-oxidization capability of the iron and steel surface. With further study on the iron nitride materials, people discovered that the iron nitride materials have characteristics of excellent ferromagnetic performance, good anti-abrasion performance, good anti-corrosion performance, good anti-oxidization performance and the like, and are good candidate materials of a high-density magnetic recording medium and a thin film magnetic head. Therefore, people started further study on the iron nitride materials. Because nitrogen contents in the iron nitride materials are different, the iron nitride materials have different crystal structures, many phases exist, particularly in phases with strong ferromagnetism, γ'-$Fe_4N$, α"-$Fe_{16}N_2$ and ε-$Fe_3N$ are included, and the phases have been deeply studied for more than 50 years. Although predecessors found through measurement that an α"-$Fe_{16}N_2$ phase is a "giant magnetic phase" long ago. However, up till now, whether the α"-$Fe_{16}N_2$ has a great magnetic moment or not is still open to debate, mainly because the α"-$Fe_{16}N_2$ is a metastable phase, and it is relatively difficult to prepare single-phase α"-$Fe_{16}N_2$. Due to its easy-to-decompose performance, although a pure α"-$Fe_{16}N_2$ material is prepared, great limitation may exist in practical application. A saturation magnetization intensity of the γ'-$Fe_4N$ is only second to a maximum saturation magnetization intensity value of the α"-$Fe_{16}N_2$, but the γ'-$Fe_4N$ has high thermal stability and low coercivity, belongs to an ideal material with soft magnetic characteristics, has the advantages of good anti-abrasion performance, anti-corrosion performance, high hardness, high resistivity and the like, and belongs to a potential magnetic storage medium and a magnetic head material.

However, it is challenging to prepare the γ'-$Fe_4N$. Till now, most material preparation work is prepared based on a thin film material. Although there are some reports about particle material preparation, the purity of the γ'-$Fe_4N$ prepared by used methods is low. Most γ'-$Fe_4N$ is mixed with other iron nitride phases or other nonideal forms and granularities. In the used methods, an ammonia gas is generally used as a nitrogen source to provide nitrogen atoms. A nitrogen content of an obtained material is generally about 6%, and does not exceed 10%. The material is a mixture with a low content of the γ'-$Fe_4N$, a pure phase is difficult to reach, and the excellent soft magnetic characteristics of the γ'-$Fe_4N$ are seriously influenced. According to atom proportion requirements of the γ'-$Fe_4N$, the content of nitrogen atoms in the γ'-$Fe_4N$ should be about 20%, but a solid solubility of the nitrogen atoms in iron is only 11.7%. Therefore, by a conventional nitrogen doping method, the γ'-$Fe_4N$ with a maximum purity of about 50% can be obtained, that is, the greatest obstacle troubling the preparation of the material is a nitrogen atom content problem. How to overcome the defect of solid solubility of the nitrogen atoms in the iron and improve the purity of the γ'-$Fe_4N$ is a bottleneck of the preparation of the material. However, for practical application of the γ'-$Fe_4N$ to a power electronic device, the nanometer γ'-$Fe_4N$ with a high volume-phase ratio is required to show high magnetic conductivity and low loss at a high frequency, and a smaller device such as a transformer and an inductor operated in a high-frequency semiconductor switch can be finally realized. Therefore, there is an urgent market demand for a pure-phase nanometer γ'-$Fe_4N$ soft magnetic material with high saturation magnetization intensity, high magnetic conductivity, low coercivity and high resistivity.

SUMMARY

In order to solve the above problems, the disclosure discloses a method for preparing pure-phase nanocrystal γ'-$Fe_4N$ by using liquid nitrogen through high-speed ball milling, wherein on the one hand, the liquid nitrogen is used for providing a low-temperature environment; more importantly, the liquid nitrogen is directly used as a nitrogen source, so that the problem of a limitation of a low nitrogen content caused by the use of an ammonia gas as the nitrogen source to provide nitrogen atoms in the γ'-$Fe_4N$ in a conventional process is solved; and at a temperature of the liquid nitrogen, through ball milling process control, an iron raw material is in a very brittle state, a surface volume ratio is very high, and the nitrogen atoms are directly attached onto a surface of iron to form a nitrogen atom supersaturation state, so that the limitation of solid solubility of the nitrogen atoms in the iron in the conventional process is broken. According to the disclosure, high energy in the liquid nitrogen is used for preparing a sample by a cryo-milling method. The liquid nitrogen can be used as the nitrogen source to obtain amorphous $Fe_xN$ of Fe with a certain metastable supersaturation degree, and then, annealing is performed so that a phase change from α-Fe to γ'-$Fe_4N$ is realized. A good soft magnetic material with characteristic magnetic performance and structures, particularly with low coercivity and high resistivity, is obtained. According to a specific method of the disclosure, the iron raw material and a ball milling product are treated in a nitrogen gas environment in a glovebox; particles are protected from being oxidized; certain ball milling conditions are matched to obtain amorphous $Fe_xN$ powder with nanometer granularity; then, the ground powder is subjected to post-annealing for a phase change; and an annealing temperature is controlled between 200° C. and 300° C., so that nitrogen atom activation, phase change assistance and γ'-$Fe_4N$ phase crystallization are facilitated.

The disclosure firstly aims to provide a preparation method of a γ'-$Fe_4N$ soft magnetic material. The method uses liquid nitrogen as a nitrogen source, and comprises the following steps of:

(1) putting an iron raw material into a high-speed ball milling machine according to a weight ratio of balls to the iron powder material being 5:1 to 20:1, introducing the liquid nitrogen into a ball milling tank; and starting ball milling; and (2) then heating for annealing to obtain the γ'-$Fe_4N$ soft magnetic material.

In one implementation mode of the disclosure, the method uses liquid nitrogen as a nitrogen source for preparation by combining ball milling and annealing processes, and comprises the steps of:

(1) putting an iron raw material into a ball milling machine at a weight ratio of balls to the iron raw material being 5:1 to 20:1, introducing the liquid nitrogen into a ball milling tank; and starting ball milling; and (2) then heating to 250° C. to 300° C. for annealing to obtain the γ'-$Fe_4N$ soft magnetic material.

In one implementation mode of the disclosure, the iron raw material includes iron powder.

In one implementation mode of the disclosure, a particle diameter of the iron powder is 10 nm to 1000 μm, a purity is 90% to 100%, and impurities in the iron powder can be carbon, manganese, zinc, oxygen, boron, cobalt, copper, etc.

In one implementation mode of the disclosure, an annealing temperature is 200° C. to 350° C.

In one implementation mode of the disclosure, an annealing temperature is 250° C. to 300° C.

In one implementation mode of the disclosure, the weight ratio of the balls to the iron powder material is 10:1.

In one implementation mode of the disclosure, a ball milling time in step (1) is 1 h to 200 h.

In one implementation mode of the disclosure, a ball milling temperature in step (1) is −196° C. to 25° C.

In one implementation mode of the disclosure, a ball milling temperature in step (1) maintains a liquid nitrogen temperature (−196° C.).

In one implementation mode of the disclosure, step (1) is performed at a rotating speed of 200 rpm to 10000 rpm.

In one implementation mode of the disclosure, a rotating speed of the ball milling in step (1) is 3000 rpm.

In one implementation mode of the disclosure, the ball milling machine in step (1) stops working for 1 min to 1 h after each 10 min to 10 h of work, and then can rotate reversely or can continuously rotate positively.

In one implementation mode of the disclosure, the ball milling machine in step (1) stops working for 5 min after each 1 h of work, and then can rotate reversely.

In one implementation mode of the disclosure, the annealing refers to the heating for annealing by putting a sample into a reaction furnace fully filled with a nitrogen gas, and a temperature is 200° C. to 350° C.

In one implementation mode of the disclosure, the method uses liquid nitrogen as a nitrogen source for preparation by combining ball milling and annealing processes, and comprises the steps of:

(1) putting an iron raw material into a ball milling machine at a weight ratio of balls to the iron raw material being 5:1 to 20:1, introducing the liquid nitrogen into a ball milling tank; and starting ball milling; and (2) then heating to 250° C. to 300° C. for annealing to obtain the γ'-$Fe_4N$ soft magnetic material.

In one implementation mode of the disclosure, the weight ratio of the balls to the iron raw material is 10:1.

In one implementation mode of the disclosure, the iron raw material in step (1) includes iron powder, a particle diameter of the iron powder is 10 nm to 1000 μm, and a purity is not lower than 90%.

In one implementation mode of the disclosure, a ball milling temperature in step (1) is −196° C. to 25° C.

In one implementation mode of the disclosure, a ball milling temperature in step (1) maintains a liquid nitrogen temperature (−196° C.).

In one implementation mode of the disclosure, step (1) is performed at a rotating speed of 200 rpm to 10000 rpm.

In one implementation mode of the disclosure, the rotating speed of the ball milling time in step (1) is 3000 rpm.

In one implementation mode of the disclosure, the ball milling machine in step (1) stops working for 1 min to 1 h after each 10 min to 10 h of work, and then can rotate reversely or can continuously rotate positively.

The disclosure also aims to provide the γ'-$Fe_4N$ soft magnetic material. The γ'-$Fe_4N$ soft magnetic material is prepared by the above method.

The disclosure thirdly aims to provide a transformer or an inductor operated in a high-frequency semiconductor switch. The transformer or the inductor includes the γ'-$Fe_4N$ soft magnetic material.

The disclosure fourthly aims to apply the γ'-$Fe_4N$ soft magnetic material to a power electronic device.

Beneficial Effects

1. According to an idea of the disclosure, liquid nitrogen is used as a nitrogen source, a nanometer grain size is generated in a high-energy cryogenic process. Then, through proper annealing treatment, α-Fe can be directly converted into γ'-$Fe_4N$ without generating any other Fe-N phases, and a pure phase (as shown in FIG. 5) can be basically reached. The first step of the disclosure is the high-energy cryogenic process. In this process, an iron raw material is ground into small blocks by a ball milling method, a size diameter is about 40 to 80 nm, a surface area and volume ratio is increased, nitrogen supersaturation is generated, and nitrogen atoms are adsorbed onto the surface. The second step is post-annealing, for particles with supersaturation nitrogen atoms on the surfaces, nanometer microcrystals are in an activated state, with the help of a temperature after annealing, the nitrogen is moved into the particles, and a phase change from a bcc (body-centered cubic) structure to an fcc (face-centered cubic) structure is generated, so that γ'-$Fe_4N$ microcrystals are obtained.

2. Compared with the prior art, the disclosure breaks through a conventional ammonia gas process, directly uses the liquid nitrogen as the nitrogen source, combines a cryogenic process, and is favorable for reducing a dimension of crystal structures, so that elements and structures are more uniform, and the limitation of solid solubility of the nitrogen atoms in iron is overcome. After grinding, a obvious strain remains inside a sample, so that prepared powder is more active. The cryogenic treatment in the liquid nitrogen may cause a nitridation reaction. Due to cryogenic and violent grinding effects of grinding balls, the particle diameter is reduced to a nanometer level in a relatively short time. A crystal size of grinding powder is about 40 to 80 nm, and a surface area and a powder size show similar trends to a microcrystal size. The powder is ground at the liquid nitrogen temperature, so that the powder is very brittle, but cold welding is inhibited in this process, the powder becomes more brittle in the cryogenic process, and those operations are favorable for converting the powder into an amorphous structure. The method belongs to a ball milling synthesis method performed in the liquid nitrogen, and a novel high-feasibility idea is provided for the preparation of a pure-phase γ'-$Fe_4N$ material.

3. Nanometer crystal $Fe_xN$ with a nitrogen atom supersaturation degree is obtained by the method of the disclosure, a content of nitrogen atoms adsorbed onto the surface of the sample is as high as 22%, and the solid solubility (11.7%) of the iron is reached. The post-annealing step helps the phase change from α-Fe to γ'-$Fe_4N$. The nitrogen content exceeds the saturation degree of the γ'-$Fe_4N$, and a pure phase can be basically reached. A nanometer crystal γ'-$Fe_4N$ soft magnetic material prepared by the method provided by the disclosure has high Ms (155 emu/g), low coercivity (0.7 Oe) and high surface resistivity (375 μΩ·m), and can be applied to the power electronic device. The method of the disclosure can be used as a possible alternative method for large-scale production of high-grade soft magnetic materials with ideal magnetism, and has the advantages of high surface resistivity and low cost.

DETAILED DESCRIPTION

Example 1

A starting raw material is pure iron with a purity being 99% (Alfa Aesar). Liquid nitrogen is provided by PRAXAIR. A high-speed ball milling system CM5100 (Luomen company) operates in a planetary rotation mode.

Wear-resistant stainless steel iron balls are used as a grinding medium. A mass ratio of the balls to a sample is 10:1. Before and during a grinding process, a liquid nitrogen continuous cooling tank from an integrated cooling system is used, so that the sample becomes brittle, and a volatile nitrogen element is preserved. The liquid nitrogen circulates in the system, and is continuously supplemented from an external filling system. The external filling system is precisely controlled, so that a temperature is always maintained at −196° C.

An iron raw material and a ball milling product are treated in a nitrogen gas environment in a glovebox, so that particles are protected from being oxidized. A grinding time is 90 h, and a rotating speed is 3000 rpm. The ball milling stops for 5 min each 1 h of operation. After each interval, a rotating direction is reversed so as to maintain a reaction in a uniform mode. After the ball milling is completed, a ball milling tank is put into the glovebox fully filled with a nitrogen gas. The sample in the ball milling tank is collected by a magnet, an ultrasonic method is used in an assisted way in a collection process, so that the sample attached onto a tank wall and the balls can be peeled off, and a recovery goal is achieved. After the ball milling, amorphous $Fe_xN$ powder with a 40-80 nm nanometer granularity is obtained. The ground powder is put into an annealing furnace, which is fully filled with the nitrogen gas and is heated to 300° C., so that the material generates a phase change, and a γ'-$Fe_4N$ material is obtained.

Figure 1:
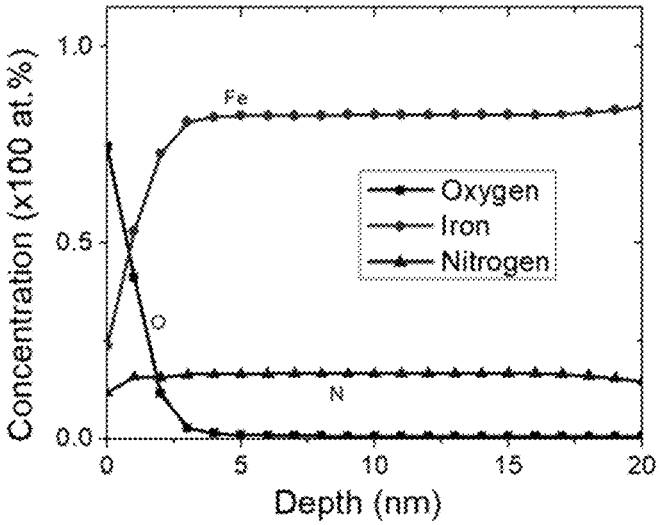
FIG. 1 is an Auger Electron Spectroscopy (AES) spectrum of the material obtained after high-speed ball milling in Example 1.
Figure 2:
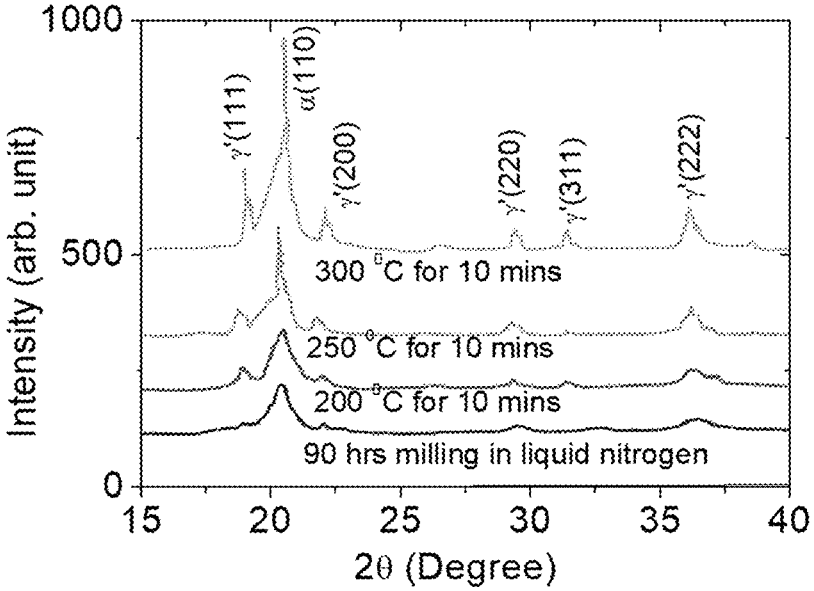
FIG. 2 is an XRD spectrum map of a material at different post-annealing temperatures in Example 2.
Figure 3:
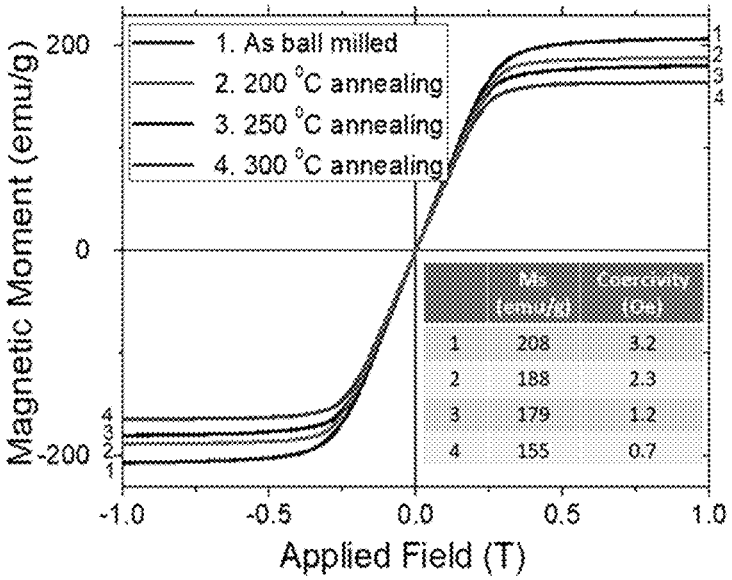
FIG. 3 is a magnetic hysteresis loop VSM diagram of the material sample prepared in Example 1.
Figure 4:
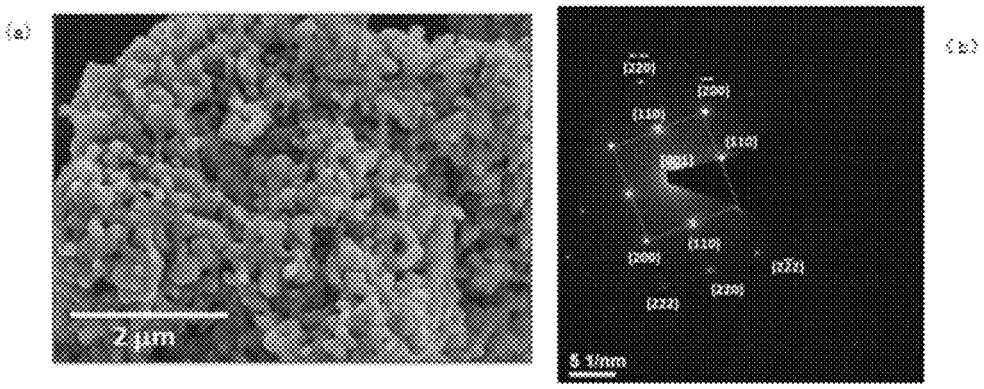
FIG. 4 is SEM and TEM characterizations on a prepared sample subjected to 300° C. post-annealing in Example 1: (a) an SEM image of the prepared sample; and (b) a diffraction pattern of the sample.
Figure 5:
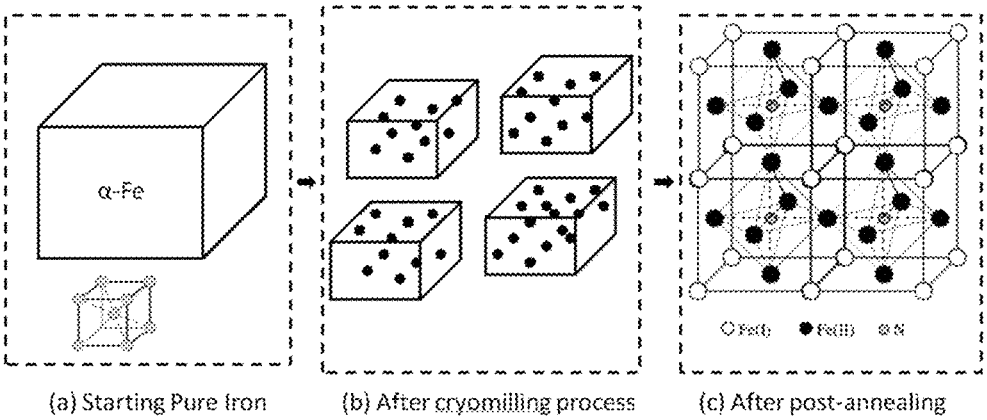
FIG. 5 is a schematic diagram of a phase change mechanism from α-Fe to γ'-$Fe_4N$ in a preparation process: (a) pure iron with a bcc structure; (b) cryomilling; and (c) a phase change into the γ'-$Fe_4N$ through post-annealing.

The obtained γ'-$Fe_4N$ material is subjected to characterization:

a result of an element concentration in the sample after a high-speed cryogrinding step by AES, as shown in FIG. 1, shows that the sample includes about 22% of nitrogen;

FIG. 2 is an XRD spectrum of a sample prepared through post-annealing, and more γ'-$Fe_4N$ peaks and sharper bcc Fe are obtained through annealing at 300° C.;

FIG. 3 shows magnetic hysteresis loops of a prepared sample, the sample prepared through the cryogrinding step shows good soft magnetic performance including Ms being 208 emu/g and Hc being 3.2 Oe. After the post-annealing, Ms value is a little reduced to about 155 emu/g, which corresponds to the phase change from α-Fe to γ'-$Fe_4N$; however, besides the change of Ms, coercivity decreases (to 0.7 Oe) along with an increase of an annealing temperature, the low coercivity comes from an ultrafine structure of the sample after the high-speed cryogenic process in the liquid nitrogen, and is caused when a grain size is between 40 nm and 80 nm; on the other hand, the prepared sample has three phases including α-Fe, amorphous Fe and γ'-$Fe_4N$, magnetostriction balance among structure phases enables the magnetostriction in the prepared sample to be close to zero, and this is another important reason for the ideal low coercivity. In a word, magnetism of the prepared sample of the disclosure shows that the sample is an ideal soft magnetic material; additionally, through the nitrogen supersaturation in the sample of the disclosure, resistivity of the sample is as high as 375 μam through measurement, which shows that the prepared γ'-$Fe_4N$ material of the disclosure can be used for a novel transformer magnetic core material with high performance and low cost; and FIG. 4 is SEM and TEM characterization results of the prepared sample: (a) an SEM image of the prepared sample, wherein the SEM image shows a regular shape of the prepared sample; and (b) a TEM transmission diffraction pattern of the sample, wherein FFT of an experimental HRTEM image with a clear contrast ratio is shown, the pattern is characterized in a γ'-$Fe_4N$ phase, growth of nitrides after a fibrous form can be observed, orientation of the image corresponding to a position near an axis [001] with an FCC structure can be determined, and the FCC structure exists. Feasibility of a ball milling synthesis method of the disclosure in the liquid nitrogen is verified by combining similar discoveries of SEM and TEM characterizations.

Example 2

With the reference to method conditions in Embodiment 1, an annealing temperature is changed into 200° C. or 250° C., other conditions are unchanged, and a γ'-$Fe_4N$ material is prepared.

The obtained material is characterized by an XRD spectrum, as shown in FIG. 2. For a sample prepared after cryogrinding, wide bcc Fe peaks are shown, and consistency with a metastable supersaturation degree of Fe converted from N is realized. Through annealing for 10 min at 200° C., a slight change of powder and slight sharpening of γ'-$Fe_4N$ peaks are caused. Through the annealing for 10 min at 250° C., sharp bcc Fe and γ'-$Fe_4N$ peaks are caused. Through the annealing at 300° C., more γ'-$Fe_4N$ peaks and sharper bcc Fe are caused. Additionally, the annealing temperature is further raised to be a little higher than 300° C., and no obvious influence is caused on XRD peaks. A result shows that wide BCC iron with nitrogen supersaturation is generated in a high-speed cryogenic process, and short-period post-annealing may cause formation of sharp BCC and γ'-$Fe_4N$.

Driving power of a phase change from α-Fe to γ'-$Fe_4N$ includes two parts: 1, surface activation energy of grinding particles; and 2, annealing energy. When ideal low-temperature materials are used, the surface activation energy does not have differences, so that annealing energy can generate an influence on generated γ'-$Fe_4N$. On the one hand, the high annealing energy causes a higher volume ratio of the γ'-$Fe_4N$ in the sample. As shown in FIG. 2, the annealing at 300° C. corresponds to a highest volume ratio of the γ'-$Fe_4N$ at 200° C. to 250° C. However, a further raise of the annealing temperature cannot further improve the phase change. Iron recrystallization is a major reason for preventing further improvement of the phase change. An iron crystallization temperature is about 350° C. The post-annealing at a temperature higher than 350° C. can favorably increase a grain size of the iron. The phase change from the α-Fe to the γ'-$Fe_4N$ may be prevented by growth of iron particles. Therefore, the post-annealing at a temperature below 300° C. corresponds to optimization conditions, the maximum annealing energy is realized for assisting the phase change from the α-Fe to the γ'-$Fe_4N$, and meanwhile, the temperature is lower than the iron crystallization temperature.

It can be seen from a VSM characterization result (FIG. 3) of the obtained material that Ms of the sample subjected to ball milling is 208 emu/g, and coercivity is 3.2 Oe. After the annealing at 200° C., Ms is 188 emu/g, and the coercivity is 2.3 Oe. At this moment, through calculation according to an XRD spectrum map, a γ'-$Fe_4N$ phase accounts for about 20% in a whole. After the annealing at 250° C., Ms is 179 emu/g, and the coercivity is 1.2 Oe. At this moment, through calculation according to the XRD spectrum map, the γ'-$Fe_4N$ phase accounts for about 35% in the whole. After the annealing at 300° C., Ms is 155 emu/g, and the coercivity is 0.7 Oe. Through calculation according to the XRD spectrum map, the γ'-$Fe_4N$ phase accounts for about 75% in the whole.

Example 3

With the reference to Embodiment 1, a weight ratio of balls to an iron powder material is changed from 10:1 to 30:1, other conditions are unchanged, and a $Fe_xN$ material is prepared. Magnetic performance of the obtained $Fe_xN$ material is similar to that of the material obtained in Embodiment 1, and a yield is about 30% of that of the material in Embodiment 1.

Comparative Example 1

With the reference to Embodiment 1, a nitrogen source is changed into an ammonia gas from liquid nitrogen, other conditions are unchanged, and a $Fe_xN$ material is prepared.

A nitrogen content of the obtained $Fe_xN$ material is 6%, Ms is 185 emu/g, the coercivity is 10 Oe, the resistivity is 25 μam, and the obtained γ'-$Fe_4N$ phase accounts for about 10% in the whole. It can be seen that a proportion of the γ'-$Fe_4N$ phase is low, so that integral performance of the prepared material is similar to that of pure iron.

What is claimed is:

1. A method for preparing a γ'-$Fe_4N$ soft magnetic material, using liquid nitrogen as a nitrogen source for preparation by combining ball milling and annealing processes, and comprising the following steps of:

(1) putting an iron raw material into a ball milling machine according to a weight ratio of balls to the iron raw material being 5:1 to 20:1, introducing the liquid nitrogen into a ball milling tank; and starting ball milling at a speed of 3000 to 10000 rpm; and (2) heating to 250° C. to 300° C. for annealing to obtain the γ'-$Fe_4N$ soft magnetic material, wherein a purity is of the iron raw material is not lower than 90% by weight, wherein ball milling is continued for 90 to 200 hours, wherein ball milling is paused every hour for five minutes and a rotating direction of the milling machine reversed, wherein the liquid nitrogen is continuously supplemented and circulates through the ball milling machine from before ball milling and during the ball milling, and wherein in step (2) the annealing is performed in a furnace filled with nitrogen gas.

2. The method according to claim 1, wherein the weight ratio of the balls to the iron raw material is 10:1.

3. The method according to claim 1, wherein the iron raw material in step (1) comprises iron powder, and wherein a particle diameter of the iron powder is 10 nm to 1000 μm.

4. The method of claim 1, wherein the γ'-$Fe_4N$ soft magnetic material produced by the method has a resistivity of 375 μΩ·m.

5. A method for preparing a γ'-$Fe_4N$ soft magnetic material, using liquid nitrogen as a nitrogen source for preparation by combining ball milling and annealing processes, and comprising the steps of:

(1) putting an iron raw material into a ball milling machine, then introducing the liquid nitrogen into a ball milling tank, and starting ball milling at a speed of 3000 to 10000 rpm, wherein a ball milling temperature in step (1) is −196° C. to 25° C.; and (2) heating to 300° C. for annealing to obtain the γ'-$Fe_4N$ soft magnetic material wherein a purity is of the iron raw material is not lower than 90% by weight, wherein ball milling is continued for 90 to 200 hours, wherein ball milling is paused every hour for five minutes and a rotating direction of the milling machine reversed, wherein the liquid nitrogen is continuously supplemented and circulates through the ball milling machine from before ball milling and during the ball milling, and wherein in step (2) the annealing is performed in a furnace filled with nitrogen gas.

6. The method according to claim 5, wherein a ball milling time in step (1) is 9 hours.

7. The method according to claim 5, wherein a weight ratio of the balls to the iron raw material is 5:1 to 20:1.

8. The method according to claim 5, wherein the iron raw material in step (1) comprises iron powder, and wherein a particle diameter of the iron powder is 10 nm to 1000 μm.

9. The method according to claim 5, wherein a ball milling temperature in step (1) maintains a liquid nitrogen temperature of −196° C.

10. The method of claim 5, wherein the γ'-$Fe_4N$ soft magnetic material produced by the method has a resistivity of 375 μΩ·m.

* * * * *